US007166194B2

(12) United States Patent
Straub et al.

(10) Patent No.: US 7,166,194 B2
(45) Date of Patent: Jan. 23, 2007

(54) WATER JET CUTTER

(75) Inventors: Karlheinz Straub, Heidenheim (DE); Michael Sollinger, Stuttgart (DE); Ralf Pfifferling, Gerstetten (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/418,332

(22) Filed: Apr. 19, 2003

(65) Prior Publication Data

US 2003/0196531 A1 Oct. 23, 2003

(30) Foreign Application Priority Data

Apr. 20, 2002 (DE) ..... 102 17 723

(51) Int. Cl.
*D21F 1/66* (2006.01)

(52) U.S. Cl. ..... 162/264; 162/286; 162/275; 162/289; 162/278; 162/279; 162/232; 162/189; 162/194; 83/53; 83/77; 83/98; 83/177

(58) Field of Classification Search ..... 162/264, 162/286, 275, 289, 278, 279; 83/53, 98, 83/167, 177, 77, 402
See application file for complete search history.

(56) References Cited

U.S. PATENT DOCUMENTS

| | | | | |
|---|---|---|---|---|
| 3,891,157 A | | 6/1975 | Justus | 242/56.2 |
| 4,182,170 A | | 1/1980 | Grupp | 83/177 |
| 4,560,438 A | | 12/1985 | Tell et al. | 162/194 |
| 5,185,063 A | * | 2/1993 | Aula et al. | 162/193 |
| 5,644,962 A | * | 7/1997 | Koponen et al. | 83/177 |
| 6,214,168 B1 | | 4/2001 | Puustinen et al. | 162/205 |
| 6,327,948 B1 | * | 12/2001 | Tuori | 83/53 |
| 6,413,375 B2 | | 7/2002 | Böck et al. | 162/186 |
| 6,524,443 B2 | * | 2/2003 | Doelle et al. | 162/264 |

FOREIGN PATENT DOCUMENTS

| | | |
|---|---|---|
| DE | 3907216 | 9/1989 |
| WO | WO91/03359 | 3/1991 |
| WO | WO 97/11814 | 4/1997 |
| WO | WO 01/76835 | 10/2001 |
| WO | WO02/28605 | 4/2002 |

* cited by examiner

*Primary Examiner*—Mark Halpern
(74) *Attorney, Agent, or Firm*—Taylor & Aust, P.C.

(57) ABSTRACT

A water jet cutter for separation of a trim strip from a moving paper, cardboard, tissue or other type of fiber web, in a machine for the production and/or conversion of the fiber web, including at least one nozzle whose water jet is directed onto the fiber web. An advantage of the present invention is to simplify the construction of the device while maintaining at least equal operational reliability, and to enable installation above a pulper in order to eliminate the necessity for removal and extraction systems.

10 Claims, 1 Drawing Sheet

WATER JET CUTTER

This application claims foreign priority of application 10217723.6 filed in Germany on 20 Apr. 2002.

BACKGROUND OF THE INVENTION

1. Field of the Invention

The present invention relates to a water jet cutter for separation of a trim strip from a moving paper, cardboard, tissue or other type of fiber web, in a machine for the production and/or conversion of the fiber web, including at least one nozzle whose water jet is directed onto the fiber web.

2. Description of the Related Art

Because of the high pressure of the water jet and the assurance of a clean cut while avoiding tears or web breaks, the fiber web is supported on the opposite side when cutting by way of a water jet. This support is generally provided by a cutting table. During operation contamination of the support surfaces, caused by the fibers or the additives in the fiber web occurs. In addition, the high pressure of the water jet over a period of time leads to wear and tear of the surfaces that are impacted by the water jet.

The cutting table, therefore, is often equipped with an opening opposite the water jet, for extraction and removal of the contaminants and the water. The separated strip is sucked into a discharge hopper, with the assistance of vacuum. This is particularly costly with regard to keeping the cutting table clean and with regard to discharging the strip.

What is needed in the art is to simplify the construction of the cutter and provide at least equal operational reliability.

SUMMARY OF THE INVENTION

The present invention provides a water jet cutter located approximately above a pulper, for the purpose of capturing the trim strip that is separated from the fiber web. In this position in the paper machine, the cutter does not require any discharge and/or vacuum systems. The expensive cutting table may therefore be reduced to a support plate. The support plate is of extremely simple construction and during cutting assures sufficient support of the fiber web in the cutting area. The support plate is equipped with a cutout for the water jet, so that it can pass through unimpeded.

After the cutting point the separated trim falls off the support plate. After the support plate the flow of the separated trim can be influenced by a guide device, preferably in the form of a guide plate and/or a guide component of the guide plate and/or a compressed air nozzle and/or a water jet nozzle. In order to prevent damage to the fiber web and to counteract contaminant accumulation, the support plate can provide a sliding surface that is as flat as possible and that progresses approximately parallel to the fiber web.

To achieve perfect cutting quality and a stable cutting process the fiber web can run at a distance along the support plate, at least when uncompromised by the water jet. Because of the flat and preferably smooth sliding surface, sliding of the fiber web during cutting does not present any negative effects. It has been shown to be advantageous if the distance between the fiber web and the sliding surface of the support plate, particularly when uncompromised, is in the range of 0 to 2 mm, preferably between 0 and 0.5 mm.

The waste and pieces of the fiber web are collected in the pulper and the fiber stock preparation in order to be reutilized. Since the guide device supports the transportation of the separated trim into the pulper, expensive suction devices for guiding the separated trim can be avoided.

In order to adapt to certain operational conditions, the nozzle and/or the support plate and/or the guiding device can be adjustable relative to their location. Because of the already improved consistency the water jet cutter can be located in the unsupported section of the fiber web, in the area of the dryer section. In its unsupported state, the fiber web runs without being supported on a belt, a roll or a similar device.

The installation location is particularly easily realized based on the pulper location at the end of a dryer group, preferably after the last dryer cylinder of the dryer group, which is the reason why the water jet cutter preferably is installed there. After leading off of the dryer fabric of the dryer group, the water jet cutter can be located advantageously between one, specifically the last dryer cylinder in the dryer group and a subsequent guide roller.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
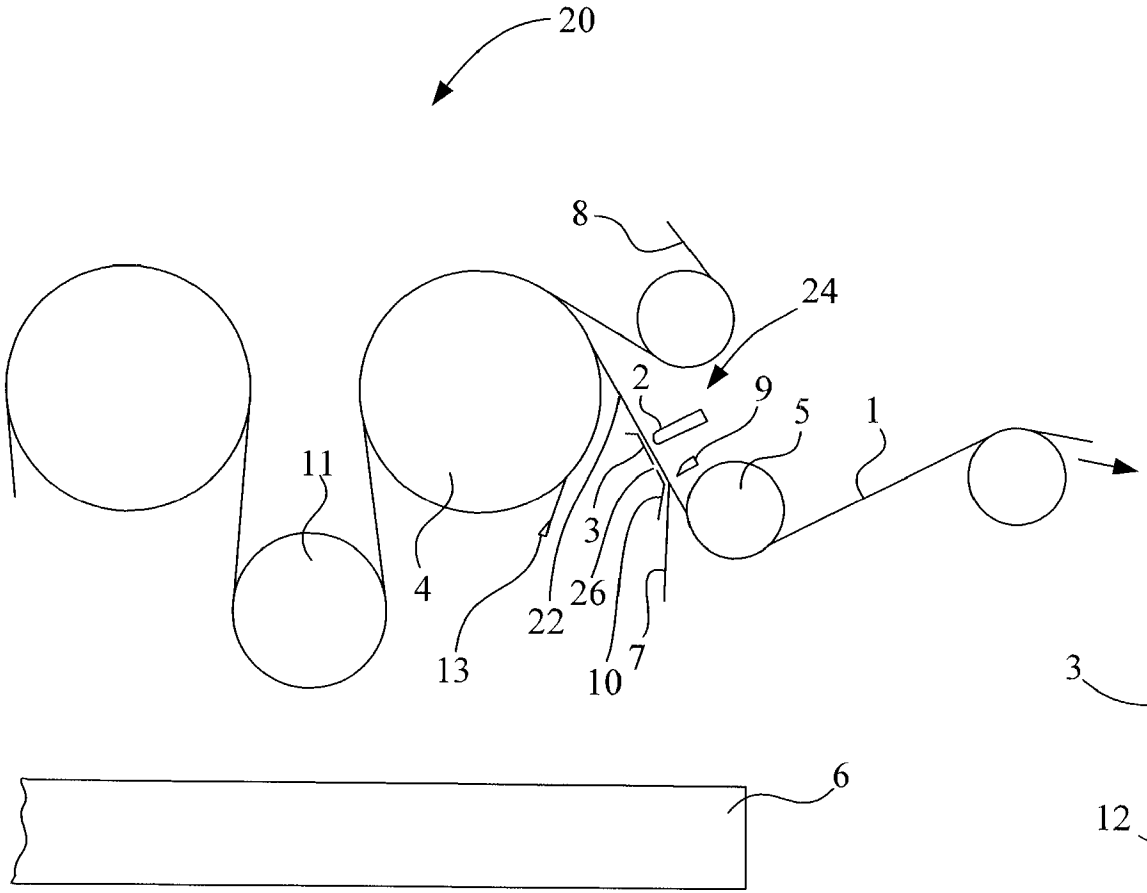
FIG. 1 is a schematic side view of an embodiment of an operational water jet cutter of the present invention.

Referring now to the drawings, and more particularly to FIG. 1, there is shown a dryer section or group 20 of a paper machine wherein fiber web 1 runs usually alternates over heated dryer cylinders 4 and suction equipped guide rollers 11 for the purpose of being dried. Fiber web 1 is carried by at least one dryer fabric 8 of the respective dryer group, whereby fiber web 1 comes into contact with dryer cylinders 4.

During drying the moisture content of fiber web 1 decreases and the consistency increases. In order to produce clean edges on fiber web 1, the water jet cutter is utilized. Because of the increased consistency of fiber web 1 this can occur in the unsupported section 22 of fiber web 1.

Figure 2:
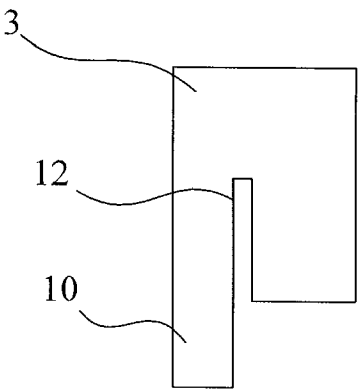
FIG. 2 is a top view of an embodiment of a support plate of the present invention.

This is relatively easy at the end of one dryer group, and specifically as shown in FIG. 1, at the end of the last dryer group. After leading off the corresponding dryer fabric 8, fiber web 1 travels into the area of water jet cutter 24. This is located between dryer cylinder 4 and a subsequent guide roller 5. Water jet cutter 24 includes essentially a nozzle 2 that is located above fiber web 1 and that directs the water jet approximately vertically onto fiber web 1. Support plate 3 is located on the opposite side for the purpose of supporting fiber web 1. Support plate 3 is equipped with a flat and smooth surface and, in uncompromised condition, is located at a distance 26 of between approximately 0–2 mm, and preferably 0.5 mm from fiber web 1. During cutting however, fiber web 1 is pressed against support plate 3. In order to avoid splash-back support plate 3 is equipped with cut-out 12 to accommodate the water jet according to FIG. 2. In addition, support plate 3 includes guide component 10 that assists the further transportation of the separated trim into pulper 6 of the dryer section. Guide component 10 can be adjustable relative to its location.

Since support plate 3 extends parallel to the direction of travel of fiber web 1, there is no possibility of fiber or other dirt accumulation.

After support plate 3, separated trim 7 is transported into pulper 6 that is located underneath water jet cutter 24. The collected fiber web pieces can then be reutilized.

In order to be able to control trim 7 after support plate 3, guide devices are provided. After support plate 3, a compressed air or water nozzle 9 blows trim 7 in the direction of pulper 6. Compressed air or water nozzle 9 can be adjustable relative to its location. Also, fiber stock remnants that may adhere to dryer cylinder 4 are removed from dryer cylinder 4 by doctor blade 13.

After water jet cutter 24, fiber web 1 travels into another area of the paper machine, for example for coating or glazing of fiber web 1. The water jet cutter is of very simple construction and in continuous operation saves a great deal of energy, because the trim removal does not require a suction device.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A machine for at least one of production and conversion of a fiber web including an unsupported section of the fiber web, comprising:

a water jet cutter for separation of a trim strip from the moving fiber web, said water jet cutter including at least one nozzle providing a water jet directed onto the fiber web, said water jet cutter being located in the unsupported section of the fiber web;

a dryer group, said water jet cutter being located at an end of said dryer group, said dryer group including a last dryer cylinder in said dryer group, said water jet cutter being located after said last dryer cylinder as viewed in a running direction of said fiber web; and a pulper located approximately below the water jet cutter for capturing a separated strip separated from the fiber web.

2. The water jet cutter of claim 1, further including a support plate on a side of the fiber web opposite at least one said nozzle, the fiber web running along said support plate.

3. The water jet cutter of claim 2, wherein said support plate creates a sliding surface that progresses approximately parallel to the fiber web.

4. The water jet cutter of claim 3, wherein the fiber web travels a distance along said support plate when uncompromised by said water jet.

5. The water jet cutter of claim 3, further including a distance between the fiber web and said sliding surface, said distance is between approximately 0 and 2 mm.

6. The water jet cutter of claim 5, wherein said distance is between approximately 0 and 0.5 mm.

7. The water jet cutter of claim 1, further including a flow associated with said separated strip, a guide component associated with said support plate and, proximate to said nozzle, at least one of a compressed air nozzle and a water jet nozzle, said flow after said support plate being influenced by at least one of said support plate, said guide component, said air nozzle and said water jet nozzle.

8. The water jet cutter of claim 7, wherein at least one of said nozzle, said support plate, said guide component, said air nozzle and said water jet nozzle are adjustable relative to their location.

9. The water jet cutter of claim 1, further including a dryer section, said unsupported section being an area of said dryer section.

10. The water jet cutter of claim 1, further including a dryer cylinder and a subsequent guide roller, said water jet cutter being located between the dryer cylinder and the subsequent guide roller.

* * * * *